United States Patent [19]

Parviainen

[11] Patent Number: 5,054,773

[45] Date of Patent: Oct. 8, 1991

[54] SYSTEM OF EQUIPMENT FOR PHYSICAL EXERCISE

[75] Inventor: Arno Parviainen, Vantaa, Finland

[73] Assignee: David International Ltd., Vantaa, Finland

[21] Appl. No.: 476,267

[22] Filed: Feb. 7, 1990

[30] Foreign Application Priority Data

Feb. 7, 1989 [FI] Finland ..... 890580

[51] Int. Cl.[5] ..... A63B 21/062

[52] U.S. Cl. ..... 272/118; 272/134

[58] Field of Search ..... 272/93, 117, 118, 134, 272/DIG. 4, 144; 119/17, 29

[56] References Cited

U.S. PATENT DOCUMENTS

| | | | |
|---|---|---|---|
| 2,785,506 | 3/1957 | Ragazzo | 119/29 X |
| 2,808,807 | 10/1957 | Widton et al. | 119/29 X |
| 2,839,027 | 6/1958 | Lanza | 119/29 X |
| 2,932,509 | 4/1960 | Zinkin | 272/117 |
| 3,640,528 | 2/1972 | Proctor | 272/118 |
| 3,749,061 | 7/1973 | Connelly | 119/17 X |
| 3,902,717 | 9/1975 | Kolkens | 272/134 |
| 4,016,833 | 4/1977 | Ray | 119/17 |
| 4,286,782 | 9/1981 | Fuhrhop | 272/134 X |
| 4,390,179 | 6/1983 | Szkalak | 272/134 X |
| 4,907,798 | 3/1990 | Burchatz | 272/134 |
| 4,917,047 | 4/1990 | Wazeter, III | 119/17 |

FOREIGN PATENT DOCUMENTS

| | | |
|---|---|---|
| 2026330 | 2/1980 | United Kingdom . |
| 2091567 | 8/1982 | United Kingdom . |

OTHER PUBLICATIONS

The Marcy Gym-King 77, advertised in Marcy Catalog, 1974, pp. 8-9.

*Primary Examiner*—Robert Bahr

*Attorney, Agent, or Firm*—Kane, Dalsimer, Sullivan, Kurucz, Levy, Eisele and Richard

[57] ABSTRACT

A modular system of equipment for physical exercise includes various devices designed for the exercising of different muscles. The system includes a number of separate frame modules, each having an essentially rectangular form and provided with coupling elements enabling the modules to be linked together, or mounted individually on a wall. In addition, the frame modules are provided with mounting elements enabling separate exercising devices without frame structures to be mounted on and supported by the modules.

7 Claims, 5 Drawing Sheets

SYSTEM OF EQUIPMENT FOR PHYSICAL EXERCISE

BACKGROUND OF THE INVENTION

The present invention relates to a system of equipment for physical exercise.

At present, there are separate devices designed for the exercising of almost every muscle or group of muscles in the human body. Such devices have been specifically designed for the exercising of a given group of muscles and are therefore hardly usable for any other purposes in physical exercise. If an establishment for physical exercise is to be provided with a good variety of equipment, then it is necessary to acquire dozens of these separate devices, requiring large investments and plenty of room.

The object of the invention is to eliminate the drawbacks referred to. A specific object of the invention is to achieve a new system of equipment for physical exercise, allowing the use of modular exercising devices consisting of the same kind of parts as far as possible, simplifying the structural solutions employed in the exercising devices and reducing their space requirement.

SUMMARY OF THE INVENTION

According to the invention, the system of equipment for physical exercise consists of a number of separate frame modules having an essentially rectangular form and provided with suitable coupling elements enabling the modules to be detachably connected to each other when mounted side by side in a vertical position. In addition, these wall-like frame modules of the invention have no separate legs or equivalent supports and are provided with mounting elements permitting the attachment of separate exercising devices without frame structures, said devices only consisting of suitable benches, supports, levers and equivalent elements which, when mounted on and supported by the frame structure, form a usable assembly of equipment for physical exercise.

In a preferred embodiment of the invention, the wall-like frame modules are linked together by means of the coupling elements to form a freestanding ring-type upright assembly consisting of three or more frame modules, depending on the space available and the desired number of devices. This ring-type assembly may preferably have a circular or elliptical form or a form freely selectable according to the space available.

In another embodiment of the invention, the frame modules are connected to each other by means of the coupling elements to form an essentially straight wall, which can be attached to the walls of the room or held upright by means of separate supports. It is also possible to use separate brackets by means of which the frame modules are fastened to the walls either separately or as an assembly of modules coupled together.

The coupling elements provided on the frame modules preferably consist of suitable hinges or links enabling the angle between adjacent wall-like frame modules to be freely selected as required in each case.

In a preferred embodiment of the invention, the rectangular frame module is provided with a counterforce device, e.g. a pack of weight plates movable along guide rails and provided with a power transmission belt, said device being placed within the space delimited by the module walls, so that, using the mounting elements, suitable structures of levers and bars designed to actuate this pack of weights can be attached to the frame module.

A preferred embodiment of the invention comprises frame modules of two different widths but of the same height and depth, so that, when coupled together side by side, they will form an even wall structure. In this case, the wider frame modules, which are provided with weight plates, can be equipped with various exercising devices requiring a counterweight, while the narrower frame modules, which are simpler in construction, can be equipped with various benches and bars which do not require the use of a counterweight. The frame modules, regardless of width, are provided with suitable mounting elements placed at different locations and different heights, and the exercising devices to be attached to them are provided with corresponding fixtures matching the mounting elements, so that each exercising device can be mounted on an appropriate frame module at the required height and in the required position. The mounting elements on the frame modules and the corresponding fixtures on the exercising devices may consist of suitable mounting flanges and holes, and of bolts or other tightening means adapted to them, but it is also possible to use various latches or other quickaction fastening elements enabling the devices to be secured and released without the aid of tools.

Compared to previously known techniques, the invention provides the advantages of significant reductions in the space requirement and costs of physical exercise establishments, because the system of the invention allows the costs per exercising device to be considerably reduced. Moreover, since the frame modules of the invention have a wall-like construction and can be erected independently, the modules can be arranged so as to divide the exercising halls into quite different compartments and areas, thus obviating the need for erecting partitions in large halls while still offering the user more pleasure and privacy in exercising than is possible in large halls where all the equipment and activities are simultaneously exposed to the sight of all those present. A further advantage is that frame modules and execrsing devices can be so combined as to produce an assembly that suits the user's individual needs and resources as well as the space available.

BRIEF DESCRIPTION OF THE DRAWINGS

In the following, the invention is described in detail by referring to the appended drawings, in which.

DESCRIPTION OF THE PREFERRED EMBODIMENT

Figure 1:
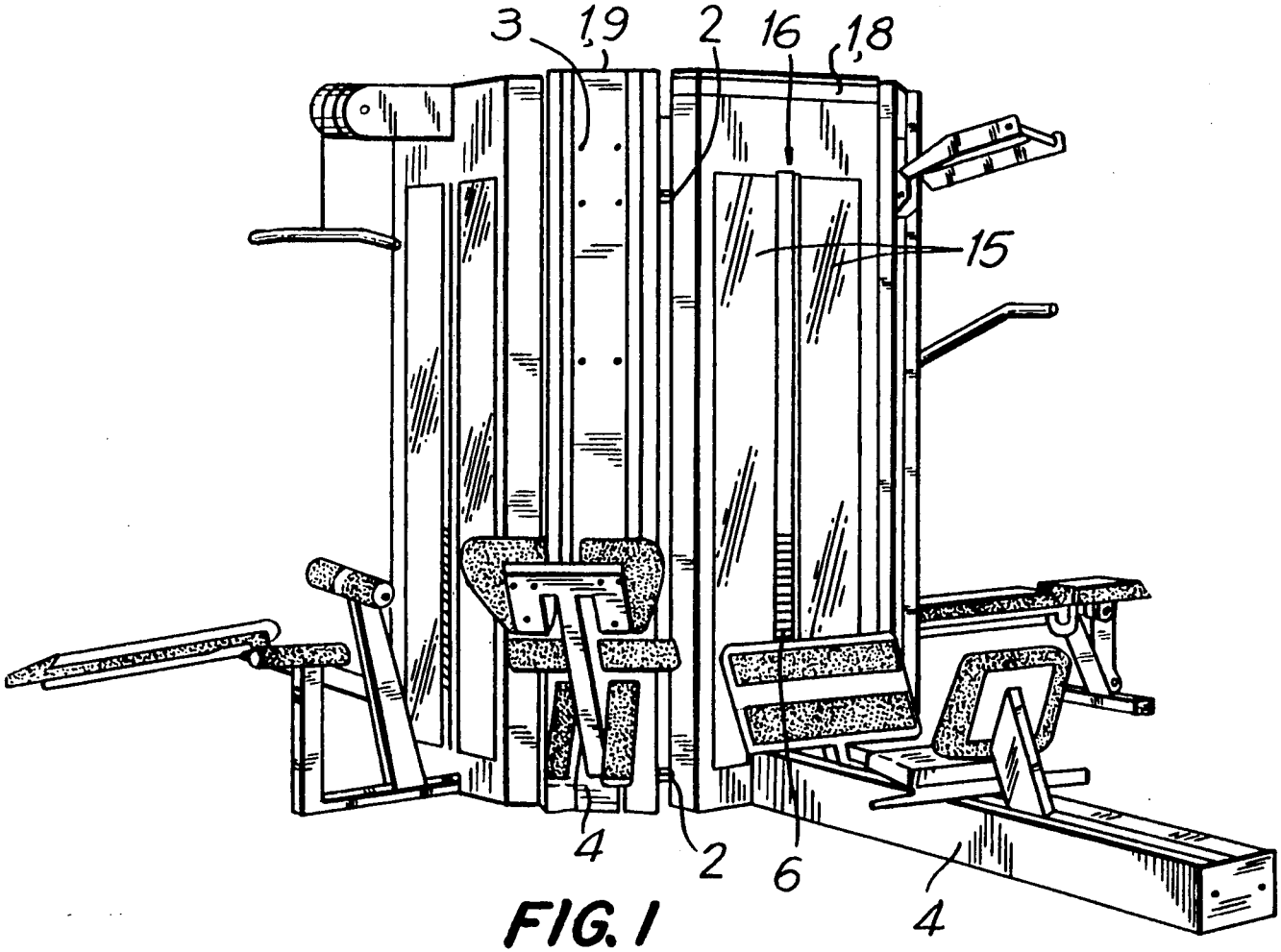
FIG. 1 presents a general view of a system implemented as provided by the invention.

FIG. 1 shows an embodiment of the system of exercising equipment of the invention, the body of which consists of eight rectangular frame modules 1 linked together so as to form an octagonal ring-like assembly. The embodiment illustrated uses two different types of frame module arranged alternately, so that the system comprises four wide frame modules 8 and four narrow frame modules 9.

Figure 4A:
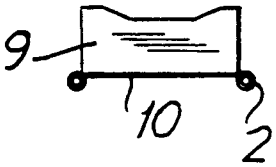
Figure 4B:
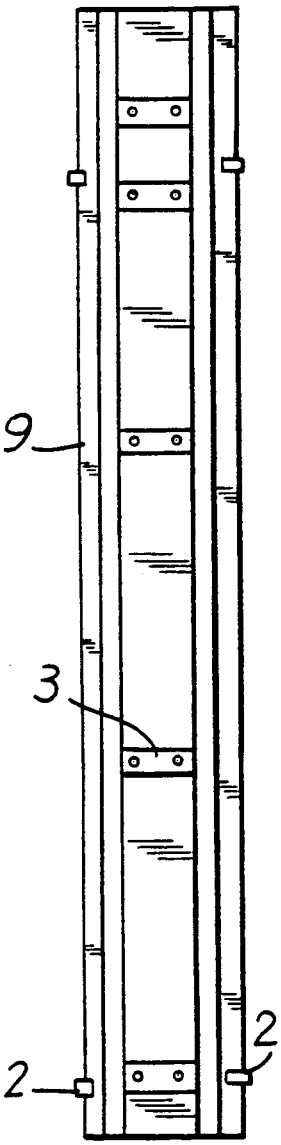

The narrower frame module 9 is constructed as depicted in FIGS. 4*a* and 4*b* consisting of an enlongated rectangular wall with approximate dimensions of 2 m in height, 30 cm in width and 10 cm in depth. The front surface of this solid wall is provided with mounting elements 3, in this case suitable reinforcements with mounting holes placed at certain locations, permitting different exercising devices 4 to be mounted on the frame module at different heights as required in view of the practical purpose of the device in question. The rear side 10 of the narrower frame module 9 is an essentially straight and even surface. Attached to the rear corners of the module, close to the upper and lower ends of it, are socket-type coupling elements 2, by means of which the frame modules can be linked together by placing them so that the coupling elements of adjacent modules are aligned one on top of the other and inserting a hinge pin or equivalent through the coupling elements.

Figure 3A:
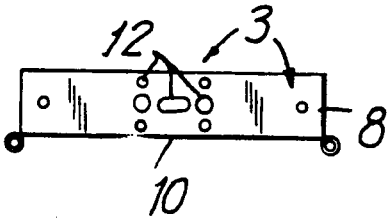
FIGS. 3*a*, 3*b*, and 3*c*, illustrate a frame module structure, in FIGS. 4*a* and 4*b* illustrate another frame module structure.
Figure 3B:
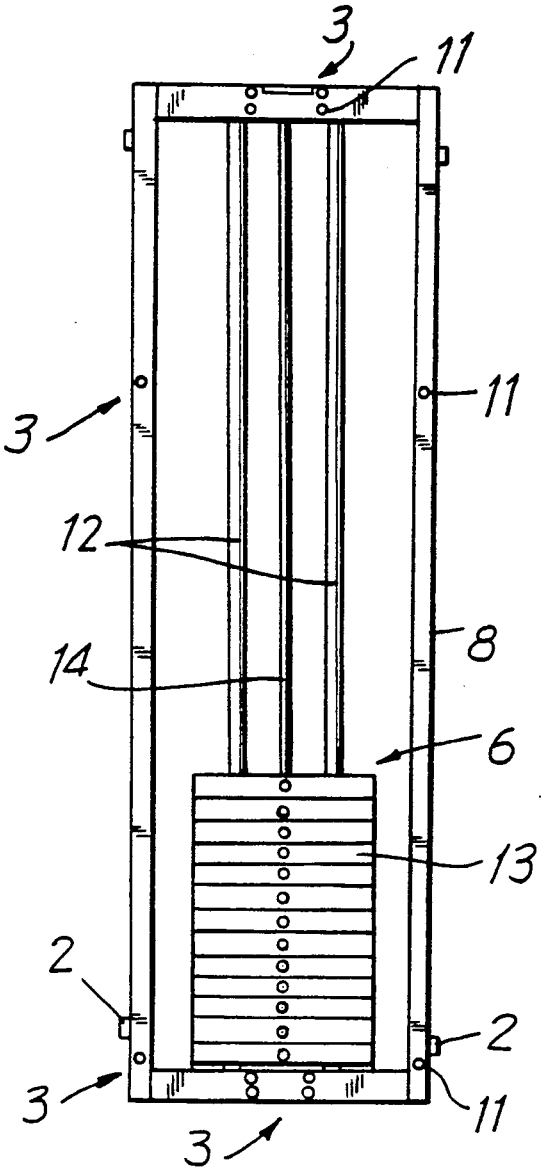
Figure 3C:
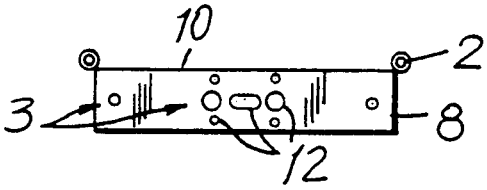

FIGS. 3*a*, 3*b* and 3*c* present a more detailed view of the wider frame module 8 used in the system. It consists of a skeleton which has the same height and depth as the narrower module but is about twice as wide, and whose side edges are provided with coupling elements 2 corresponding to those of frame module 9. In addition, the module skeleton is provided with various mounting elements 3, such as holes 11 in the front surface and openings and holes 12 of different sizes in the upper and lower end members. Various exercising devices, benches, bars and levers can be installed in these mounting elements 3. In the interior space delimited by the skeleton of the frame module are guides 12 carrying a pile of weight plates 13 constituting a counterforce device 6, which can be connected with a pulling means 14 to exercising devices installed in the mounting elements 3 of the frame module.

Like frame module 9, frame module 8, too, has an essentially straight rear surface 10. Thus, when linked together to form a larger wall, the frame modules form an essentially even surface. As shown in FIG. 1, the front surface of the wider frame module 8 can be provided with suitable boards 15, e.g. transparent plastic boards, hiding most of the counterforce device inside the module and leaving only a narrow gap 16 between them to provide access to the counterforce control means.

Figure 5:
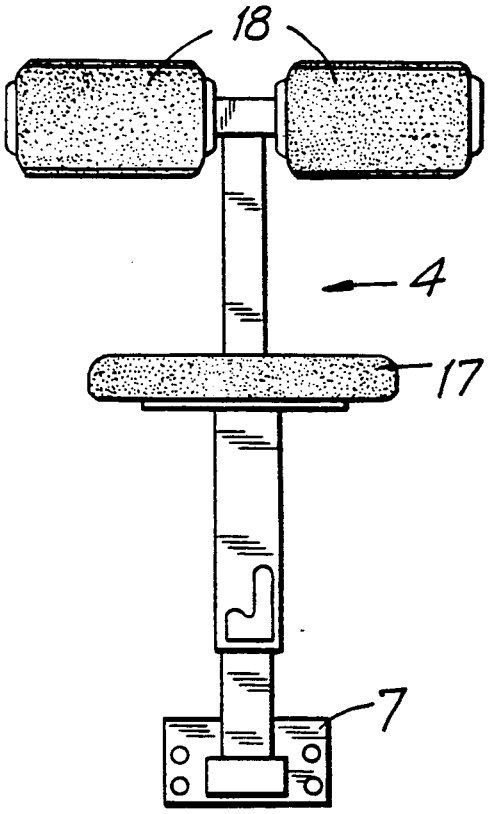
FIGS. 5 and 6 illustrate an exercising device designed to be mounted on a frame module.
Figure 6:
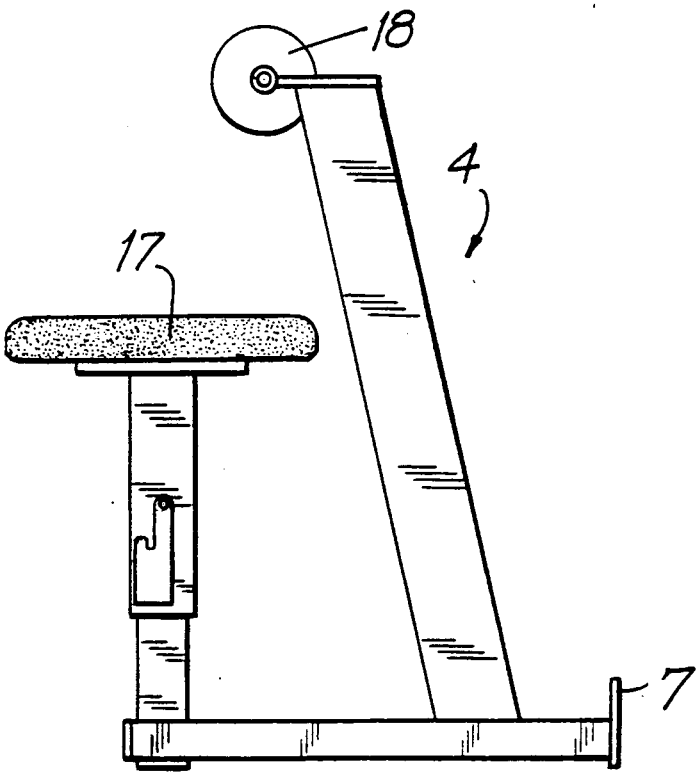

FIGS. 5 and 6 illustrate an exercising device 4 which can be mounted on a narrow or a wide frame module 9,8. It consists of a padded bench 17 and padded bolsters 18 for backing the user's thighs. In addition, the device is provided with fixtures 7, i.e. plates provided with holes, enabling the device to be attached to the frame module 9 by means of bolts inserted through the appropriate holes in the mounting elements 3 and the fixtures. If such a bench structure is mounted on the lower part of a wide frame module 8 and a suitable lever or bar connected to the counterweight is mounted on the upper part of the module, the resulting combination allows a person sitting on the bench to exercise by operating the counterweight in a manner known in itself.

Figure 9:
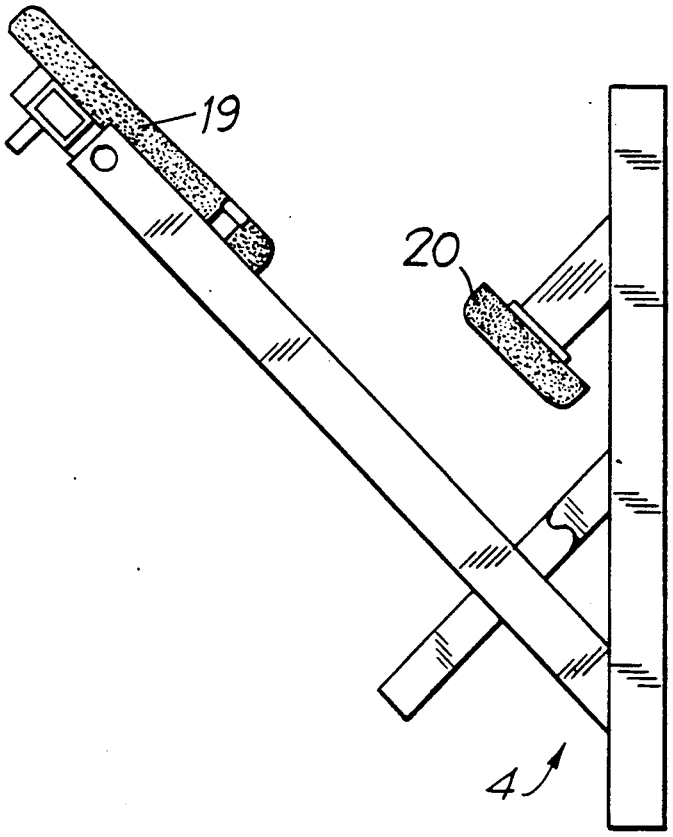
FIGS. 9 and 10 present another exercising device designed to be mounted on a frame module.
Figure 10:
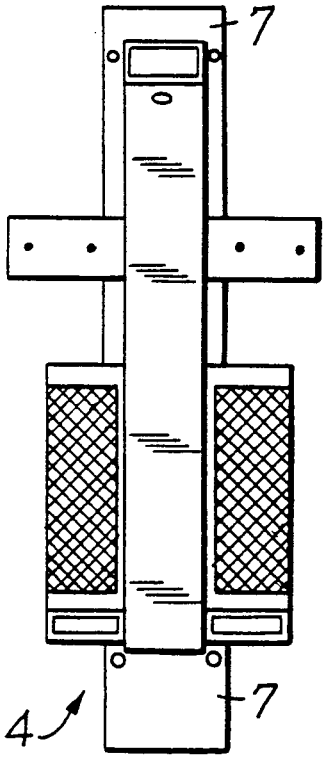

FIGS. 9 and 10 illustrate another exercising device 4 designed for use in connection with the frame modules of the invention. In this case, too, the device 4 cannot be used independently, but when attached by means of fixtures 7 to the mounting elements 3 of a narrow frame module 9, it can be used in a known manner for the exercising of the dorsal extensors, with the user's pelvis resting on the cushion 19 and his legs pressed against the padded stopper 20. In the same way, various exercising devices which have no frame of their own and therefore cannot be used independently can be mounted on suitable frame modules of either width to form usable exercising devices.

Figure 2:
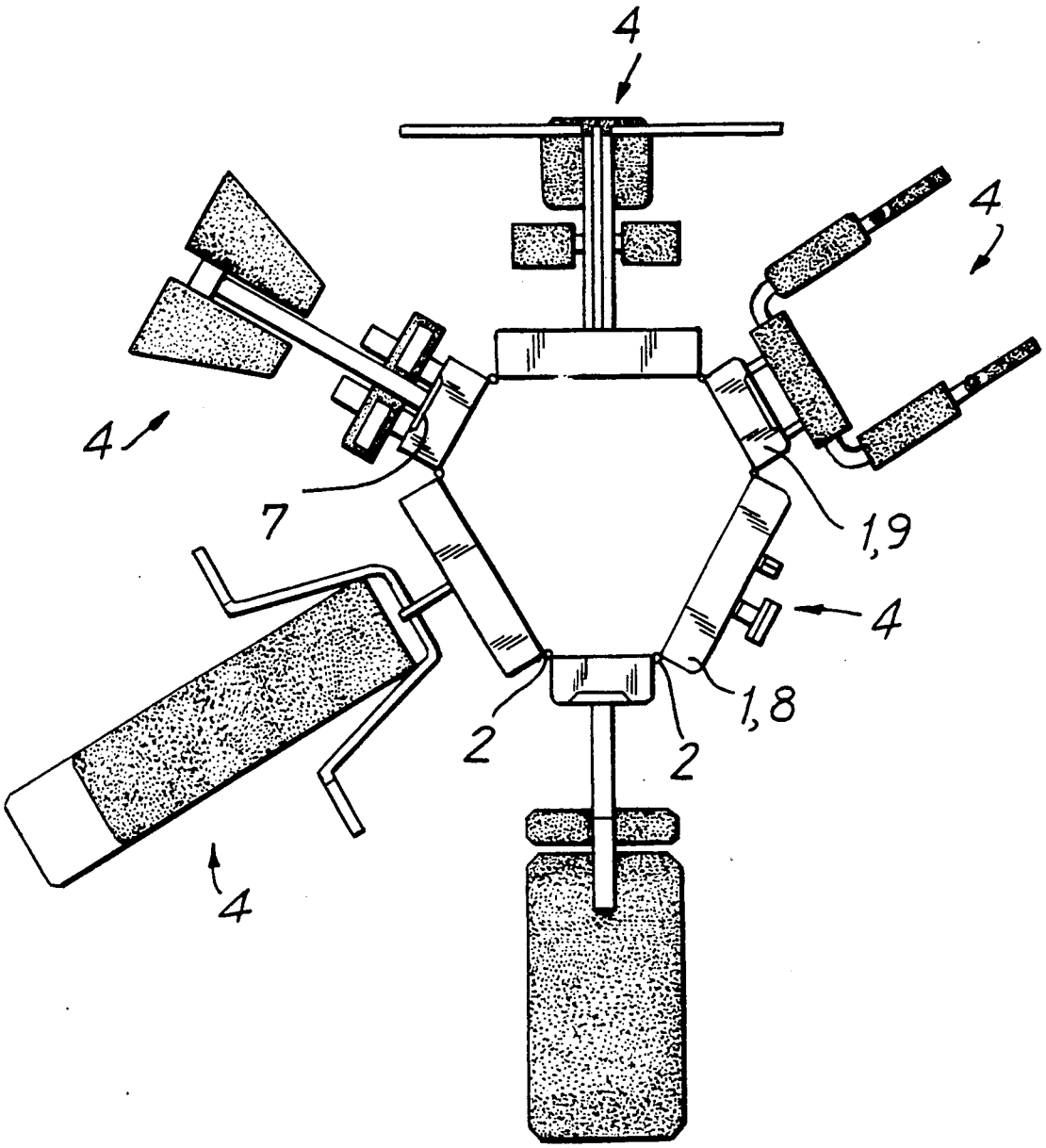
FIG. 2 presents a schematic diagram of a system implemented as provided by the invention.

FIG. 2 shows a diagrammatic top view of a system of exercising equipment similar to that in FIG. 1. This embodiment comprises three wide frame modules 8 and three narrow frame modules 9 linked together alternately to form a hexagonal frame in which each module accommodates a different exercising device.

Figure 7:
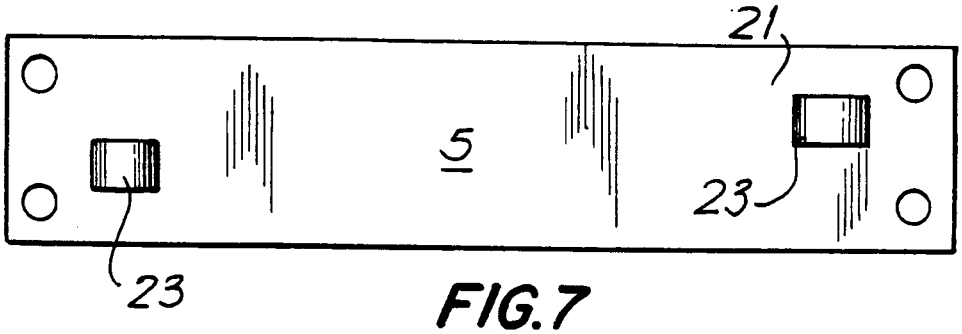
FIGS. 7 and 8 illustrate a mounting bracket designed for use in the system.
Figure 8:
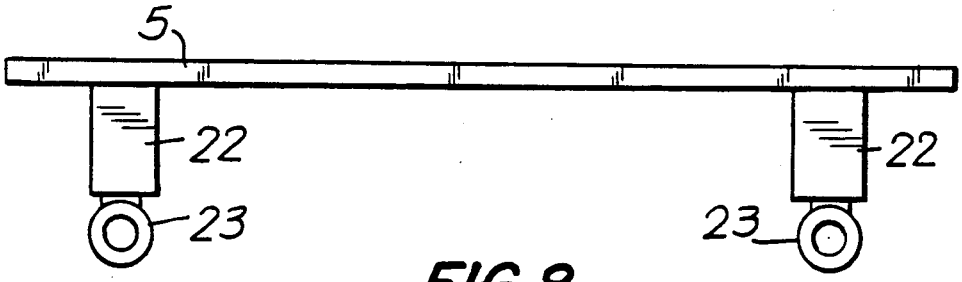

FIGS. 7 and 8 illustrate an embodiment of the invention which enables the frame modules to be mounted separately on a wall. A frame module can be attached directly to a wall by using a mounting bracket as shown in FIGS. 7 and 8. The bracket consists of a plate 21 provided with two studs 22 with a socket 23 at the end, the studs being placed at a distance between them corresponding to the distance between the coupling elements 2 of the frame module. Thus, by means of the coupling elements 2 and corresponding sockets 23, the frame module can be installed on mounting brackets 5 fastened to the wall. In this way, a given exercising hall space can be utilized very effectively by using only modular structures as provided by the invention and arranging part of the equipment in ring-type assemblies as illustrated by FIGS. 1 and 2 and mounting the rest on the walls.

In the foregoing, the invention has been described in detail by referring to some of its structural solutions. However, its embodiments may vary within the scope of the idea of the invention as defined in the following claims.

I claim:

1. A modular system of equipment for physical exercise upon which various devices designed for the exercising of different muscles may be mounted comprising a plurality of frame modules, each of said frame modules having an essentially rectangular form with height, width, sides and faces and having a plurality of coupling elements on said sides, so that each of said plurality of frame modules may be fitted and detachably connected to another of said plurality of frame modules to be mounted side by side in a vertical position, each of said plurality of frame modules further having a plurality of mounting elements on said faces, so that various exercising devices may be mounted on and supported by each of said plurality of frame modules, and at least one frame module of said plurality housing a counterforce device, said counterforce device being a stack of plate-like weights, said counterforce device being linkable to an exercising device, when an exercising device is mounted on said frame module.

2. A modular system according to claim 1 wherein each of said plurality of frame modules is linked to another of said plurality of frame modules by said coupling elements to form a ring-like freestanding assembly.

3. A modular system according to claim 1 wherein each of said plurality of frame modules is linked to another of said plurality of frame modules by said coupling elements to form an essentially straight assembly for attachment to a support structure.

4. A modular system according to claim 3 further comprising a plurality of mounting brackets for attachment to a support structure, so that said plurality of frame modules may be mounted on said mounting brackets by said coupling elements.

5. A modular system according to claim 1 wherein said coupling elements are a link structure allowing continuous adjustment of the angle between two adjacent frame modules of said plurality of frame modules.

6. A modular system according to claim 1 further comprising an exercising device, said exercising device being provided with mounting fixtures, so that said exercising device may be mounted on one of said plurality of frame modules by said mounting elements of said frame.

7. A modular system according to claim 1 wherein said plurality of frame modules comprises frame modules of at least two different widths, said frame modules having identical height.

* * * * *